AU 166 Ex
5/15/79 XR 4,154,694

United States Patent [19]
Donaldson

[11] 4,154,694
[45] * May 15, 1979

[54] DETERGENT COMPOSITIONS

[75] Inventor: Robert Donaldson, Wirral, England

[73] Assignee: Lever Brothers Company, New York, N.Y.

[ * ] Notice: The portion of the term of this patent subsequent to May 11, 1993, has been disclaimed.

[21] Appl. No.: 912,662

[22] Filed: Jun. 5, 1978

Related U.S. Application Data

[62] Division of Ser. No. 790,162, Apr. 22, 1977.

[30] Foreign Application Priority Data

Jan. 19, 1973 [GB] United Kingdom ..... 2907/73

[51] Int. Cl.[2] ..... C11D 9/04
[52] U.S. Cl. ..... 252/98; 252/103; 252/156; 252/160; 252/110; 252/112; 252/117; 252/547; 252/550; 252/DIG. 14

[58] Field of Search ..... 252/98, 103, DIG. 14, 252/156, 160, 547, 550, 112, 110, 117

[56] References Cited

U.S. PATENT DOCUMENTS

| | | | |
|---|---|---|---|
| 3,454,500 | 7/1969 | Lancashire | 252/112 |
| 3,522,186 | 7/1970 | Cambre | 252/110 |
| 3,536,628 | 10/1970 | Lancashire | 252/117 |

*Primary Examiner*—Mayer Weinblatt
*Attorney, Agent, or Firm*—James J. Farrell; Melvin H. Kurtz; Kenneth F. Dusyn

[57] ABSTRACT

A pourable liquid detergent composition, particularly one containing hypochlorite, comprises an aqueous detergent solution having a yield stress value at 20° C. of from 1 to 21 dynes/cm$^2$, and dispersed solid particles of a sparingly water-soluble alkaline buffer, particularly calcium or magnesium hydroxide, providing a pH within the range of from 10 to 13.

4 Claims, No Drawings

DETERGENT COMPOSITIONS

This is a divisional, of application Ser. No. 790,162, filed Apr. 22, 1977 and still pending.

This invention relates to pourable liquid detergent compositions.

The preparation of pourable liquid detergent compositions that are aqueous solutions containing detergent micellar complexes and are capable of maintaining solid particles in dispersion is described in British Patents Nos. 1,303,810 and -1,308,190 and U.S. Pat. No. 3,956,158. Such compositions have a yield stress value, that is, they exhibit Bingham plastic characteristics and require a definite threshold stress to be applied before they will flow. If the force which causes particle deposition, namely gravitational force acting on the dispersed solid particles relative to that acting on the the liquid medium, with a magnitude proportional to the difference in density between the medium and the particles, is less than the yield stress value, particles dispersed in the medium do not separate out. The composition becomes pourable after a shear stress greater than the yield stress has been applied, for instance when the shear stress provided by gravity on tilting a vessel containing the composition is greater than the yield stress value.

Formulation of the liquid detergent composition may make desirable the control of its pH in order to provide it with the optimum properties, for instance, where a pH-sensitive ingredient is present, and especially where the composition is alkaline, to avoid drift of pH towards acidity due to absorption of atmospheric carbon dioxide. Such drift can be compensated for by using a sufficiently high pH, but it is undesirable that the composition should be highly caustic. A water-soluble buffer, for example a sodium phosphate buffer, could be employed to avoid this drift, but some of these detergent compositions are sensitive to the amount of cation present, and such a buffer introduces cations and thus reduces the freedom to formulate in order to provide the desired properties.

A solution to the problem of buffering such detergent compositions has now been found by introducing a solid buffer the bulk of which remains suspended as solid particles which the compositions, because of their yield stress value characteristics, retain in a dispersed state as a reservoir of buffer which is drawn upon when required, but which provides only a limited addition to the cation concentration.

The invention provides a pourable liquid detergent composition comprising an aqueous detergent solution having a yield stress value at 20° C. of from 1 to 21 dynes/cm$^2$, and dispersed solid particles of a sparingly water-soluble alkaline buffer providing a pH within the range of from 10 to 13.

Preferably the composition is one in which a yield stress value is provided by two or more detergent-active compounds that exhibit micellar interaction, as manifested by a solution of them containing any necessary complex-promoting agents, for instance electrolytes, having a viscosity higher than the mean of the viscosities exhibited by corresponding solutions in which only one of each of the constituent detergent-active compounds is present; such an effect is best seen on measurement of viscosity at low shear rates. Typical examples of such detergent micellar complexes are those described in British Patent No. 1,303,810, for instance those provided by the condensate of 1 mol octylphenol with 6 mols ethylene oxide in combination with dialkanolamine salts of lauric acid in the presence of dipentene; and as described in British Patent No. 1,308,190, for instance sodium lauryl sulphate in combination with lauryl alcohol in the presence of benzene. Particularly suitable are the aqueous detergent solutions described in U.S. Pat. No. 3,956,158, where the necessary yield stress value is provided by a combination of two or more detergent-active compounds that exhibit micellar interaction, together with a three-dimensional network of insoluble entangled filaments; for instance one containing an alkali metal $C_{12}$ to $C_{18}$ alkyl sulphate together with a trialkylamine oxide, trialkylphosphine oxide or dialkylsulphoxide detergent-active compound in the presence of an electrolyte with a univalent or divalent cation and a three-dimensional network of insoluble entangled filaments, especially filaments of soap, for example sodium stearate, these ingredients being in such amounts as to provide a viscosity, at 20° C. of from 1 to 60 to poise at a shear rate of 7 sec$^{-1}$, and a yield stress value at 20° C. of from 1 to 21 dynes/cm$^2$. Other aqueous solutions containing detergent micellar complexes that can be used are described in British Patents Nos. 1,167,597, 1,181,607 and 1,260,280, and U.S. Pat. Nos. 3,579,456 and 3,623,990. Detergent solutions in which the necessary yield stress value is provided by dispersed clays such as bentonite, and whose properties are particularly sensitive to electrolyte concentration, can also be used.

By "yield stress value" is meant the stress value determined in the limit of zero shear rate approaching zero shear rate using the very low shear rates attained in the low shear rate viscometer described by van den Tempel and Lucassen-Reynders, *J. Phys. Chem.*, 1963, 67, 731.

By "sparingly water-soluble" is meant a solubility in water at 20° C. within the range of from 0.0005 to 0.2 parts by weight in 100 parts water. Examples of suitable alkaline buffers are calcium hydroxide and magnesium hydroxide. Calcium oxide and magnesium oxide can be used, these being converted by reaction with water to the corresponding hydroxides. Calcium oxide and hydroxide provide a buffer pH of 12.5 and magnesium oxide and hydroxide provide a buffer pH of 10.4.

The buffers can be used in amount from 0.01%, preferably more than 0.1%, above the amount which will dissolve in the aqueous solution of detergent micellar complexes to 20, 50 of even 75%, by weight of the composition. The particles of buffer can be of diameter ranging from the very smallest solid particles, for instance those obtained by precipitation from calcium or magnesium chloride with alkali metal hydroxide, up to 500$\mu$.

The pourable liquid detergent compositions can also contain a dispersed particulate solid other than that required as buffer. Such dispersed particulate solid can be used to confer abrasive properties on the composition, when it is preferably of hardness from 1 to 9, and especially 2 to 6, on Moh's scale. Buffer material having a suitable particle size can itself provide the function of such abrasive material: thus magnesium oxide particles used in larger amount than is required to provide the buffer function can act as abrasive. Examples of suitable particulate solids other than the buffer for use as abrasives are calcite, dolomite, felspar, diatomaceous earth, talc, bentonite, pumice, alumina and silica. The particulate solid can be present for some other purpose than as abrasive: for instance, it can be a coloured pigment. It is preferably of particles of diameter within the range of from 0.1 to 500μ, and especially of mean diameter from 15 to 100μ. It will normally be used in the range of from 0.1 to 75% by weight of the composition.

Especially important are bleaching detergent compositions containing a hypochlorite, where the other components of the composition are sufficiently stable to the action of hypochlorite, such as the detergent compositions referred to above as described in U.S. Pat. No. 3,956,158. As hypochlorite is notoriously prone to loss of available chlorine at a pH less than 10, the invention provides a solution to the problem of providing a bleaching detergent composition containing hypochlorite which does not rapidly decompose due to drift in pH on storage. The hypochlorite can be employed as sodium hypochlorite in an amount from 0.02 to 4 or 5%, preferably from 0.1 to 2% by weight, or by using the equivalent amount of a hypochlorite precursor, for example, a chloramine such as Chloramine T.

In preparing the composition, the buffer can be dispersed by stirring into the remainder of the composition. Thus 0.2% by weight of calcined magnesium hydroxide can be dispersed in the composition of any one of the Examples of U.S. Pat. No. 3,956,158. Alternatively buffer can be formed in situ in a medium containing caustic alkali by adding an amount of a soluble calcium or magnesium salt, for instance the chloride, to the aqueous medium of the composition sufficient to neutralise the caustic alkali, and supplementing the precipitated calcium or magnesium hydroxide with solid buffer particles if desired.

The invention is illustrated by the following Examples.

EXAMPLE 1

A pourable liquid detergent bleaching and scouring composition was prepared from commercially available substances containing the following ingredients in parts by weight.

| | |
|---|---|
| Sodium lauryl sulphate | 1.27 |
| Sodium stearate | 0.90 |
| Dimethyllaurylamine oxide | 0.54 |
| Sodium sulphate | 0.23 |
| Sodium chloride | 0.75 |
| Aqueous sodium hypochlorite | 4.32 |
| Magnesium oxide (calcined precipitated magnesium hydroxide) | 0.12 |
| Perfume (β-ionone) | 0.12 |
| Water | 51.75 |
| Dolomite powder | 40.00 |

The aqueous sodium hypochlorite used contained 15% "available" chlorine: that is, 15 parts of chlorine were released on acidification of 100 parts with excess hydrochloric acid: the solution actually contained 15.7% sodium hypochlorite, 12.3% sodium chloride and 0.86% sodium hydroxide by weight. The dolomite powder consisted of particles of size wholly above 0.1μ and below 100μ diameter, and mean diameter 35μ; and density 2.8 and hardness 3.5.

The sodium lauryl sulphate (as noodles containing the sodium sulphate and a small amount of the water), sodium stearate and amine oxide (as a solution in some of the water) were heated with the bulk of the remaining water, the temperature being raised to about 75°, until a clear solution was obtained. The remaining water-soluble materials and the perfume dispersed in the remaining water were stirred in, and the mixture then allowed to cool to ambient temperature, when the soap had precipitated out as a three-dimensional network of entangled filaments, and the mixture had a viscosity at 20° C. of 45 poise at a shear rate of 7 $sec^{-1}$. The magnesium oxide and dolomite powder were gently stirred into the liquid medium to give a pourable liquid composition containing homogeneously dispersed particles, the composition having a yield stress value of 9 dynes/$cm^2$.

A second composition was prepared in the same way except that the magnesium oxide was omitted. The two compositions were then stored under identical conditions and their pH and available chlorine content determined before storage and at the end of each month for 4 months, with the following results.

| Months storage | | 0 | 1 | 2 | 3 | 4 |
|---|---|---|---|---|---|---|
| Composition with buffer | pH | 10.9 | 10.5 | 10.5 | 10.5 | 10.5 |
| | Chlorine % | 0.50 | 0.44 | 0.40 | 0.37 | 0.34 |
| without buffer | pH | 10.9 | 10.4 | 9.9 | 9.5 | 9.5 |
| | Chlorine % | 0.50 | 0.42 | 0.30 | 0.12 | 0.06 |

It will be seen that after 4 months the composition prepared with magnesium oxide had retained 68% of its chlorine, while that prepared without had retained only 12%.

EXAMPLE 2

A pourable liquid detergent bleaching and scouring composition of similar physical characteristics but buffered at pH 12.5, is prepared as described in Example 1, but using 0.6% by weight of calcium hydroxide power instead of the magnesium oxide and, instead of the dolomite, calcite powder of particle size wholly above 0.1μ and below 100μ diameter, 95% being below 53μ, and mean diameter 30μ; and density 2,8 and hardness 3.

EXAMPLE 3

A pourable liquid detergent bleaching and scouring composition of similar physical characteristics to those of Example 1 is prepared as described in Example 1, but using the same amount of the aqueous sodium hypochlorite solution in which has been incorporated 0.04 parts of magnesium chloride to eliminate the free sodium hydroxide with formation of finely-divided magnesium hydroxide buffer in situ.

What is claimed is:

1. A pourable liquid detergent composition comprising an aqueous detergent solution having a yield stress value at 20° C. of 1 to 21 dynes/$cm^2$ and a buffering amount of solid particles of an alkaline buffer having a solubility in water at 20° C. of 0.0005 to 0.2 parts by weight in 100 parts by weight of water and providing a pH of 10 to 13 dispersed in the solution and retained in the dispersed state by the yield value characteristics of said solution in which the aqueous detergent solution contains an alkali metal $C_{12}$ to $C_{18}$ alkyl sulphate together with a trialkylamine oxide, trialkylphosphine oxide or dialkylsulphoxide detergent-active compound in the presence of an electrolyte with a univalent or divalent cation, and a three-dimensional network of insoluble entangled filaments, these ingredients being in such amounts as to provide a viscosity at 20° C. of from 1 to 60 poise at a shear rate of 7 $sec^{-1}$.

2. A composition according to claim 1, in which the aqueous detergent solution contains hypochlorite corresponding to from 0.02 to 5% by weight of sodium hypochlorite.

3. A composition according to claim 2, in which the alkali metal $C_{12}$ to $C_8$ alkyl sulphate is sodium lauryl sulphate and the oxide detergent-active compound is dimethyllaurylamine oxide.

4. A composition according to claim 3, in which the filaments are of sodium stearate.

* * * * *